US010702898B2

(12) United States Patent
Grooms et al.

(10) Patent No.: US 10,702,898 B2
(45) Date of Patent: Jul. 7, 2020

(54) FUEL CLEANING SYSTEM

(71) Applicant: Petroleum Tec, Graham, NC (US)

(72) Inventors: Rickie Dale Grooms, Graham, NC (US); Michael Scott Knowles, Graham, NC (US)

(73) Assignee: Petroleum Tec, Graham, NC (US)

( * ) Notice: Subject to any disclaimer, the term of this patent is extended or adjusted under 35 U.S.C. 154(b) by 232 days.

(21) Appl. No.: 15/886,525

(22) Filed: Feb. 1, 2018

(65) Prior Publication Data

US 2019/0232345 A1 Aug. 1, 2019

(51) Int. Cl.

| | |
|---|---|
| ***B08B 9/08*** | (2006.01) |
| ***B08B 3/02*** | (2006.01) |
| ***B67D 7/78*** | (2010.01) |
| ***B67D 7/62*** | (2010.01) |
| ***B67D 7/76*** | (2010.01) |
| *B67D 7/04* | (2010.01) |
| *B67D 7/84* | (2010.01) |

(52) U.S. Cl.

CPC ..... *B08B 9/0813* (2013.01); *B08B 3/02* (2013.01); *B08B 9/08* (2013.01); *B67D 7/62* (2013.01); *B67D 7/76* (2013.01); *B67D 7/78* (2013.01); *B67D 7/04* (2013.01); *B67D 7/845* (2013.01)

(58) Field of Classification Search

CPC ..... B08B 9/08; B08B 9/0813; B08B 3/02; B67D 7/62; B67D 7/76; B67D 7/78; B67D 7/04; B67D 7/845

USPC ..... 134/166 R

See application file for complete search history.

(56) References Cited

U.S. PATENT DOCUMENTS

| | | | | |
|---|---|---|---|---|
| 5,409,025 | A * | 4/1995 | Semler | B01D 36/001 134/111 |
| 2007/0000558 | A1* | 1/2007 | Burris | B01D 21/04 141/65 |
| 2009/0145853 | A1* | 6/2009 | Hilsman | B08B 9/08 210/745 |
| 2010/0154828 | A1* | 6/2010 | Green | B08B 9/08 134/21 |

* cited by examiner

*Primary Examiner* — Tinsae B Ayalew

(74) *Attorney, Agent, or Firm* — James G. Passé; Passé Intellectual Property, LLC

(57) ABSTRACT

The invention describes three compartments for cleaning and dispensing fuel and cleaning out fuel storage tanks with a minimum amount of down time.

5 Claims, 5 Drawing Sheets

FUEL CLEANING SYSTEM

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records but otherwise reserves all copyright rights whatsoever.

BACKGROUND OF THE INVENTION

Field of the Invention

The present invention relates to a system for cleaning fuel and storage fuel tanks. In particular, it relates to an integrated system for cleaning storage fuel tanks and cleaning fuel that can also dispense fuel while the fuel tank is being cleaned.

Description of Related Art

The current system for dispensing diesel fuel requires that a number of modifications be made to the fuel to meet Tier 4 Final Diesel Engine fuel requirements. Diesel fuel regulations have been modified to eliminate Sulphur and add compatible Bio fuels to compensate for lubricity and other mandated regulations. This is due to EPA regulations restricting the Nitrous Oxide (NOX) emitted from the engine's exhaust. To meet these strict emissions requirements, the engine manufacturers have changed the fuel system to a higher pressure system requiring cleaner fuel. The engine's fuel specification is now more restrictive than the standards of the fuel being delivered to the end user. New regulations starting with 2018 diesel vehicles require use of diesel fuel with 2-6 micron size contaminant particles. While the 2018 vehicles are moving off the shelf, the availability of clean diesel fuel is largely non-existent. This leads to problems with not being able to fuel those new vehicles.

Another regulation for most fuels requires mixing of bio fuels with diesel fuels. Bio fuel contains as much as 10% water. Accordingly, storage fuel tanks, such as those used at places of business for fleet vehicles, have a problem with the water in their storage tanks encouraging growth of organisms which become contaminates in the fuel stored in those tanks. This becomes not only a problem for all vehicles, it creates a problem for cleaning the tank since the tank needs to be taken out of service to clean the tank, and any fuel has to either be discarded or filtered. The normal process is to wait till the tank is emptied and then do the cleaning, leaving the storage tank out of service for an extended period.

While many fleet owners have fuel storage tanks, smaller fleets rely on fuel stations for each vehicle fill. With the new diesel regulation, diesel owners are starting to need to have their own fuel storage tank so that fuel issues can be addressed when the providers of the fuel are not providing clean enough fuel.

In addition to all these problems, the remediation causes its own pollution as well as burning of less than clean fuels. Addressing these issues has become costly, as well as a pollution problem, and a more efficient system is needed to improve efficiency, maintenance cost, vehicle down time, decrease time delays, and address pollution concerns.

BRIEF SUMMARY OF THE INVENTION

The present invention relates to the use of a system which can clean fuel and a fuel storage tank, as well as continue to dispense fuel during the process in order to reduce down time, present cleaner fuels, and clean out a storage fuel tank.

Accordingly, in one embodiment, there is a system for cleaning fuel and a storage fuel tank that the fuel is in while continuing to be able to dispense fuel comprising:

a) a first compartment comprising:
   i. a fuel pump for moving fuel from the storage tank to the first compartment and back again once the storage fuel tank has been cleaned;
   ii. a filter for reducing the size of the particulate matter in the fuel wherein the filter is positioned such that fuel from the fuel storage tank is filtered before it goes into the first compartment; and
   iii. a dispensing unit for dispensing fuel to a vehicle while fuel is being stored in the compartment;

b) a second compartment comprising:
   i. a fuel tank cleaning solution; and
   ii. a device for dispensing the cleaning solution and cleaning the inside of the fuel storage tank with the cleaning solution; and c) a third compartment comprising:
   i. a pump for transferring the contents of the storage fuel tank when there is cleaning solution inside.

DETAILED DESCRIPTION OF THE INVENTION

Figure 1:
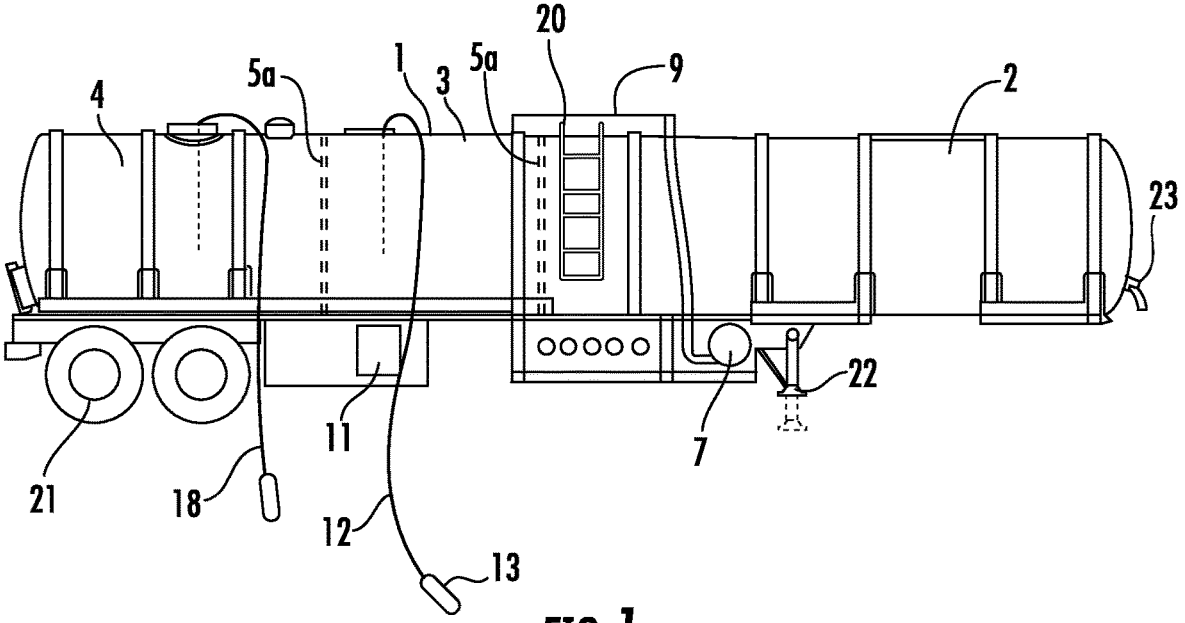
FIG. 1 is a side view of the system of the present invention wherein a tanker trailer is utilized as the container.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "filtering" refers to passing a liquid fuel through a filter to lower the size of the largest solid particle in the fuel. Standard filtration techniques can be utilized, but in one embodiment, the filter removes any particles larger than 4 microns. Filtering is done before the filtered fuel enters the first compartment such that only filtered fuel is in the first compartment.

As used herein, the term "cleaning" refers to introducing a cleaning solution to the inside of a storage fuel tank after fuel has been completely removed. The cleaning solution is under pressure, for example from a pressure cleaning head, and used to remove sludge, particulate matter, and the like that might be sticking to the inside of the storage tank. Whatever is left inside the tank is removed by a transfer pump into the third compartment.

As used herein, the term "storage fuel tank" refers to an above ground or below ground storage container designed to hold liquid fuel for dispensing to motorized vehicles. It can contain gasoline, diesel, ethanol, or any other liquid fuel used in motorized vehicles. Typically these tanks are of a size that they can contain a range of about 500 to 40000 gallons of fuel, though larger and smaller tanks can be serviced.

As used herein, the term "liquid fuel" refers to liquid fuels designed for use in motorized vehicles. These fuels include diesel, gasoline, bio-diesel, ethanol, and the like.

As used herein, the term "dispense fuel" refers to the present invention having a device that allows a vehicle to be filled with fuel from the filtered fuel in the first compartment even while fuel is being filtered into the compartment or while the fuel tank the fuel came from, and will go back to, is being cleaned and evacuated. Typically, this means an EPA approved dispensing nozzle but will depend on the exact use of and type of fuel being used. One skilled in the art can choose an appropriate nozzle, and where the first compartment will store different fuels at different times, a multiplicity of nozzles can be utilized. Essentially, a tube from the compartment fitted with a pump to move the fuel from the compartment to the nozzle and out to the vehicle is contemplated.

As used herein, the term "first compartment" refers to a compartment suitable for holding liquid fuel. It is equipped with a pump and appropriate equipment to remove fuel from the fuel storage tank and move it to the first compartment for holding during the cleaning of the storage tank. In the process of moving the fuel, the system is equipped with a particle size filter which transfers only filtered, cleaned fuel to the first compartment suitable for filling vehicles or for return to the fuel storage tank. In one embodiment, the first compartment has filtered the fuel to 4 micron or less particle size. In one embodiment, the first compartment is about 7000 gallons and, in another embodiment, it is a part of a large container which also houses the second and third compartment. The first compartment can share one or more walls with one or more of the other compartments. In one embodiment, the first compartment is made of fuel safe aluminum.

As used herein, the term "fuel pump" refers to a device for sticking into the fuel storage tank and vacuum sucking the fuel from the storage tank to the first compartment. It can also be used to pump fuel to a vehicle, although there may be two pumps for this purpose rather than one with shared duty.

As used herein, the term "filter" refers to a device for passing fuel through for the purpose of reducing the size of the largest particle in the fuel from where it is to a smaller size. For example, it could be 4 micron filter which filters out all particles larger than 4 microns, therefore if 10 micron fuel was filtered, it would remove particles between 10 and just above about 4 microns.

As used herein, the term "dispensing" refers to filling a motorized vehicle with the appropriate fuel taken from the first compartment.

As used herein, the term "second compartment" refers to a compartment suitable for containing a cleaning solution such as water or cleaning chemicals. It consists of a device for delivering the cleaning solution to the emptied fuel tank and scrubbing it. In one embodiment, it is a pressure washer system so that a pump and pressure fitting is used to clean the inside of a fuel storage tank. In one embodiment, the second compartment is about 1600 gallons in volume. The cleaning solution could be water, diesel, or the like. In one embodiment, the second compartment is aluminum compatible with the cleaning solution.

As used herein, the term "fuel tank cleaning solution" refers to any liquid water or cleaner, or the like, which can be utilized to clean the inside of a fuel storage tank. Such compositions are well known in the art.

As used herein, the term "device for dispensing cleaning solution" refers to a pump and cleaner head for cleaning the inside of the fuel tank.

As used herein, the term "third compartment" refers to a compartment for receiving used cleaning solution in the fuel storage tank and any sludge or other material loosened from the tank. Because those particles are potentially very large a pump to remove the contents of the fuel storage tank and move it to the third compartment can be the kind where particle size is largely irrelevant as long as it fits in the hose used to transfer the liquid. In general, the tank is filled and later the contents disposed of. In one embodiment, the third compartment is about 3000 gallons to allow room for the cleaning solution and any sludge is to be removed from the fuel storage tank.

In one embodiment, the three compartments are in one large container, and, in another embodiment, the large container is a tractor pulled by a trailer unit. This is the embodiment shown in the Figures. By making the three compartments part of one large container, walls can be shared as long as the material is suitable for all three compartments, such as aluminum, although stainless steel and other materials can be utilized.

Compartments are pressurized, vacuum compartments or not depending on pumping situation and the particular manner to transfer liquids.

Additional items can include walkways, pressure relieve valves, ladders, drains, hoses or pipes, self-contained power for operating pumps for transferring liquids, wheels connections for a tractor to pull the container, lights for work or for use during travel, feet for supporting the container on the ground, and the like. Other items may be clear based on the disclosure herein.

DRAWINGS

Now referring to the drawings, FIG. 1 is an embodiment wherein the container is a trailer 1 designed to attach to a tractor for towing. The container 1 has a first compartment 2, a second compartment 3, and a third compartment 4 positioned therein, wherein there are common walls 5*a* separating the compartments. In this embodiment, the compartments are 7000, 1500, and 3000 gallons respectively. First compartment 2 has pump 7 for pumping fuel from a fuel storage tank, deliver the fuel through filter 9 and into first compartment 2.

Second compartment 3 is designed to contain water and deliver it using a pump 11 through hose 12 to cleaning pressure sprayer 13 for cleaning out sludge and anything else in the fuel storage tank. Once the cleaning is completed, the sludge is pumped into third compartment 4 via a pump and hose 18.

The trailer has other features, including ladder 20, wheels 21, adjustable height feet 22, and valve 23 for dispensing gasoline from the first compartment 2.

Figure 2:
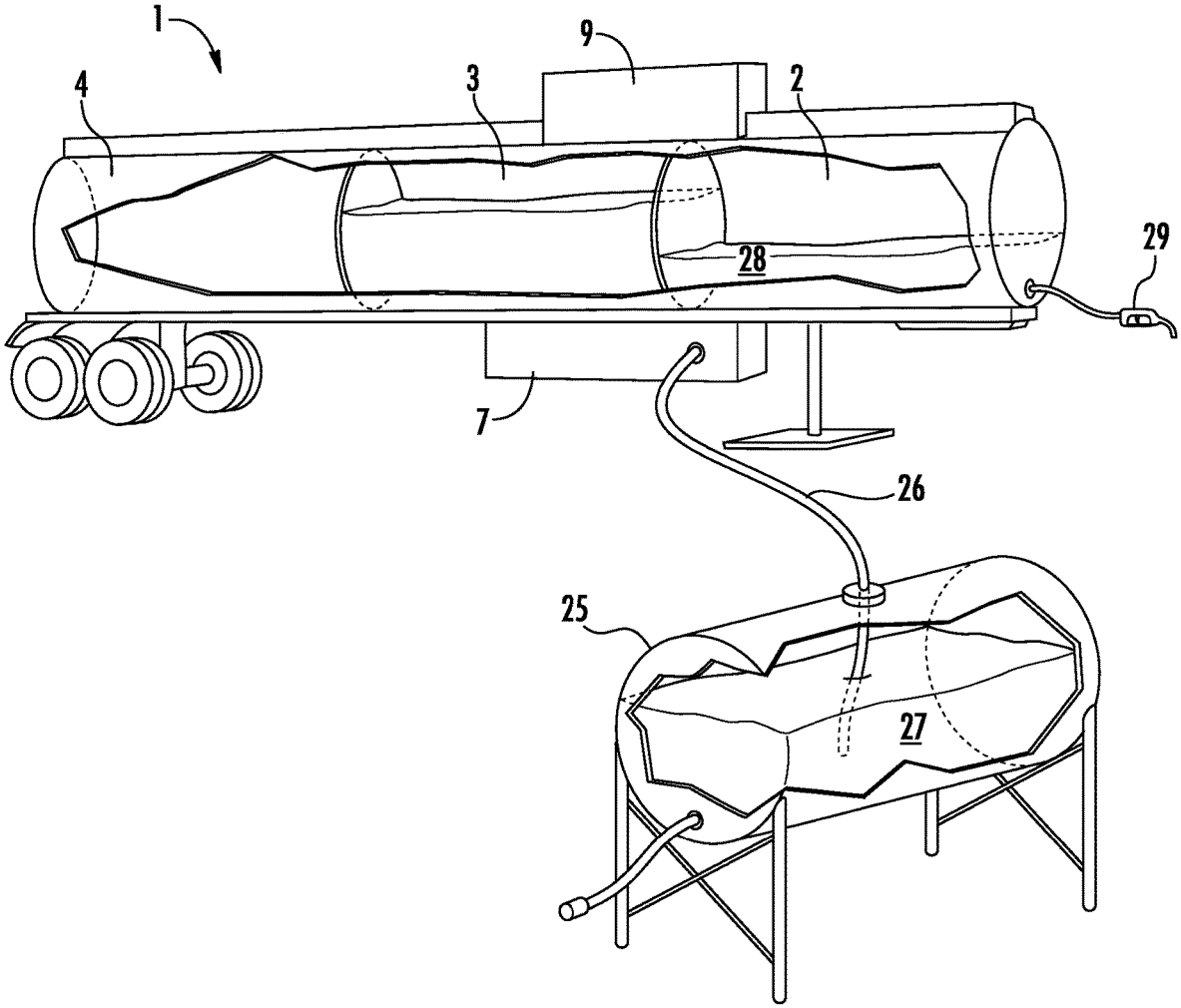
FIG. 2 is a perspective view of the system cleaning fuel.

FIG. 2 is a perspective view of the invention showing an embodiment with the filtering of fuel from a fuel storage tank. While the tank is above ground, below ground tanks are also contemplated. In this view, we see the container 1 and fuel storage tank 25. A hose 26 is placed from pump 7 into fuel storage tank 25. Fuel 27 is removed and pumped through filter 9. Clean fuel 28 can then be removed for use in vehicles via fuel dispensing handle 29.

Figure 3:
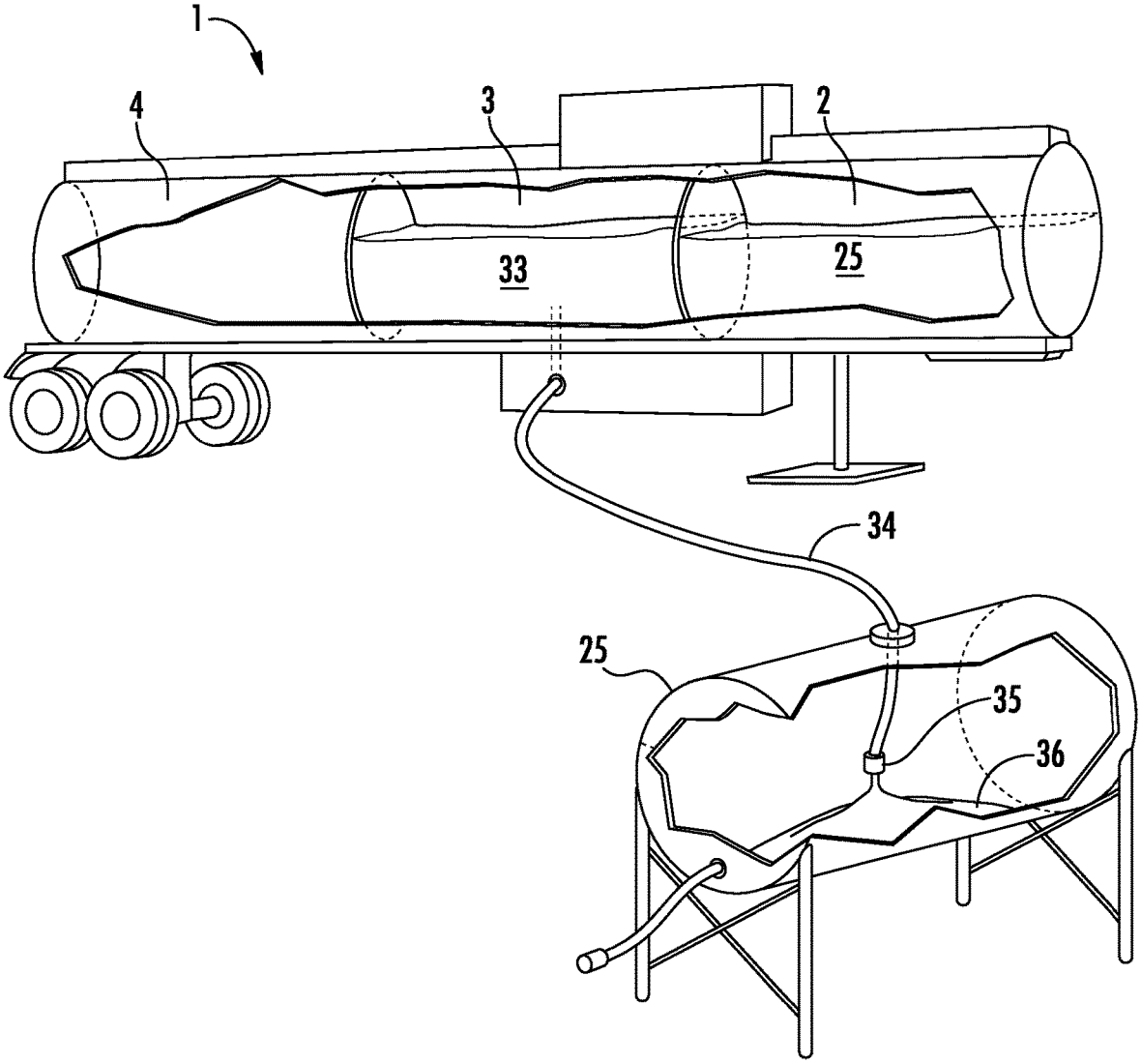
FIG. 3 is a perspective view of the system cleaning the storage tank.

FIG. 3 is a perspective view of the system 1 wherein water 33 in the second compartment 3 is pumped via hose 34 to pressure sprayer 35 which cleans the inside of the storage tank 25 now that fuel 27 has been cleaned and removed. Accumulation of dirty water and sludge 36 is removed in the next step.

Figure 4:
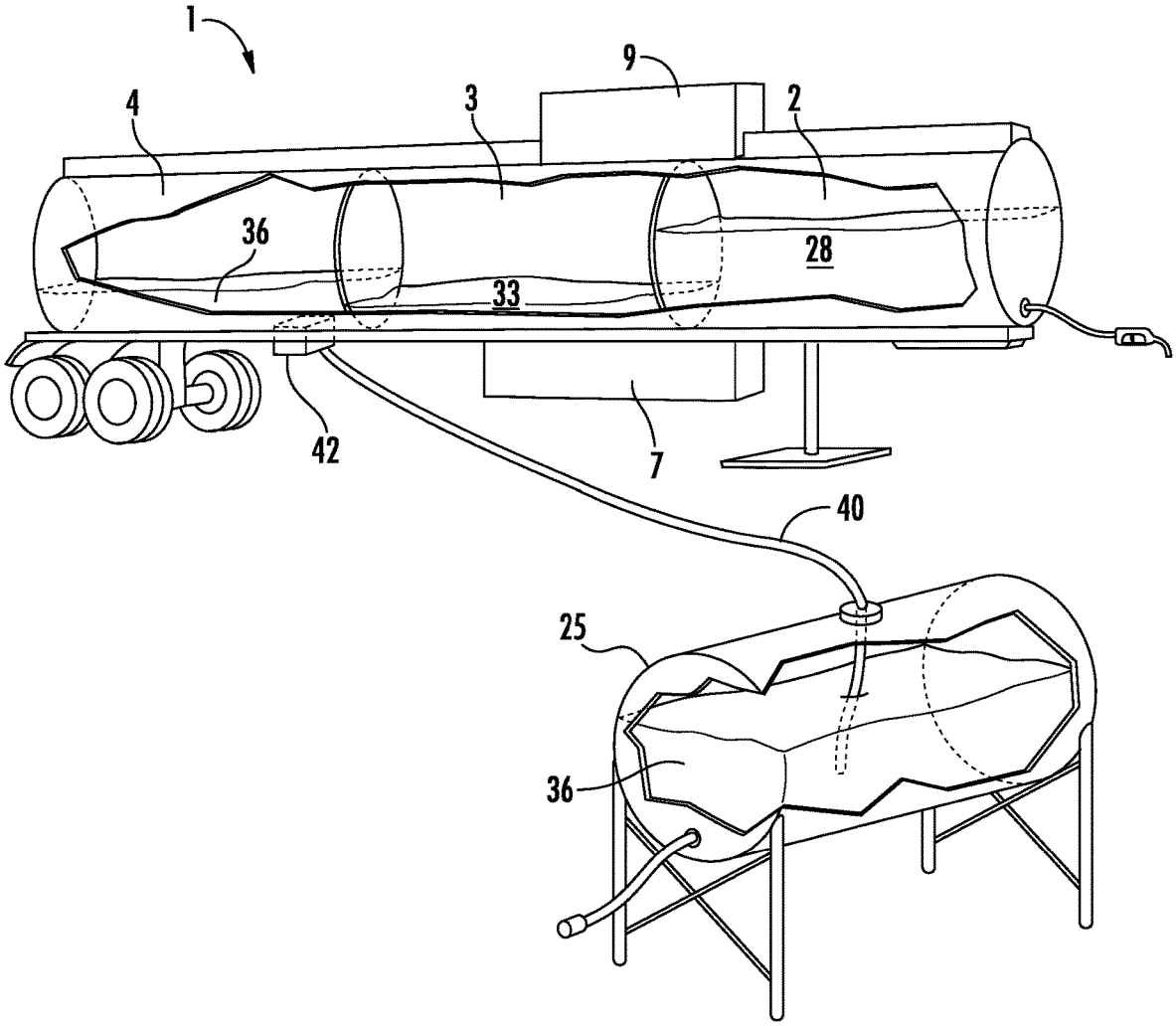
FIG. 4 is a perspective view of the system removing dirty water and sludge from the storage tank.
Figure 5:
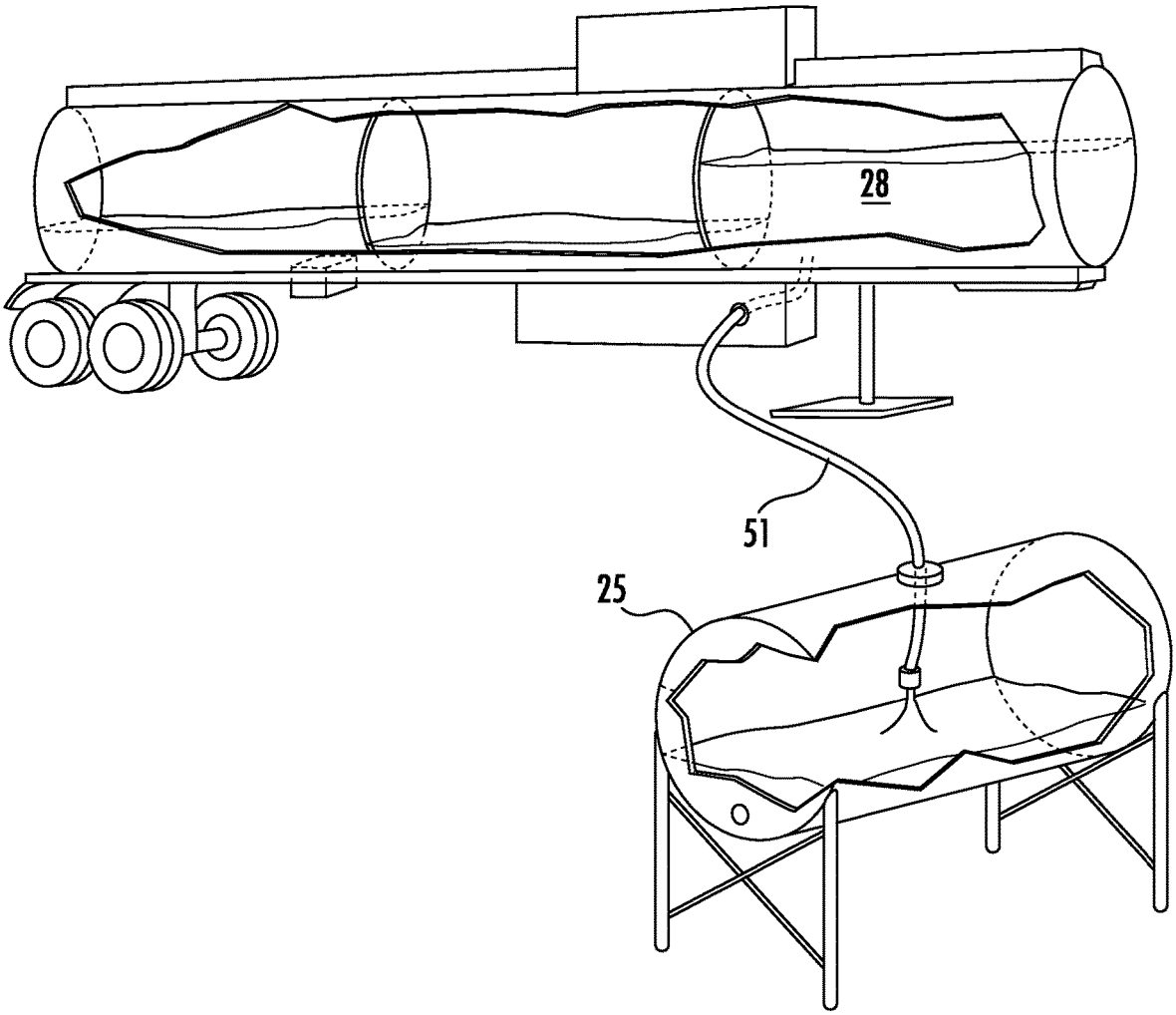
FIG. 5 is a perspective view of clean fuel being returned to the storage tank.

In FIG. 4 we see a perspective view of the system wherein the sludge 36 is removed from storage tank 25 via hose 40 and transferred via pump 42 to the third compartment 4. At this point, the inside of the storage tank 25 is left clean for return of clean fuel 28 to the storage tank 25. Lastly, in FIG. 5, there is a perspective view of the system 1 returning the cleaned fuel 28 back to the storage tank 25 via hose 51, finishing the process.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A system for cleaning a liquid fuel and a storage fuel tank that the fuel is in while continuing to be able to dispense fuel comprising:

I. a single, horizontally disposed container, the single container comprising:
  a) a first compartment comprising:
    i. a fuel pump for moving fuel from the storage tank to the first compartment and back again once the storage fuel tank has been cleaned;
    ii. a filter for reducing the size of the particulate matter in the fuel wherein the filter is positioned such that fuel from the fuel storage tank is filtered before it goes into the first compartment; and
    iii. a dispensing unit for dispensing fuel to a vehicle while fuel is being stored in the compartment;
  b) a second compartment comprising:
    i. a fuel tank cleaning solution; and
    ii. a device for dispensing the cleaning solution and cleaning the inside of the fuel storage tank with the cleaning solution;
  c) a third compartment comprising:
    i. a pump for transferring the contents of the storage fuel tank when there is cleaning solution inside; and
  d) wherein each compartment is positioned horizontally in a linear manner inside the single container with at least one common wall separating each of the compartments and wherein the single container is a trailer designed to attach to a tractor for towing.

2. The system according to claim 1 wherein the 3 compartments combined are capable of containing about 1200 gallons of fuel.

3. The system according to claim 1 wherein the compartments are aluminum.

4. The system according to claim 1 wherein the fuel is diesel fuel.

5. The system according to claim 1 wherein the fuel storage tank is an underground fuel storage tank.

* * * * *